US010188182B2

(12) United States Patent
Weiss

(10) Patent No.: US 10,188,182 B2
(45) Date of Patent: Jan. 29, 2019

(54) CLASP FOR BEADED JEWELRY

(71) Applicant: M&Y Trading Corp., Carteret, NJ (US)

(72) Inventor: Lawrence Weiss, Carteret, NJ (US)

(73) Assignee: M&Y Trading Corp., Carteret, NJ (US)

( * ) Notice: Subject to any disclaimer, the term of this patent is extended or adjusted under 35 U.S.C. 154(b) by 70 days.

(21) Appl. No.: 15/586,279

(22) Filed: May 4, 2017

(65) Prior Publication Data

US 2017/0318918 A1 Nov. 9, 2017

Related U.S. Application Data

(60) Provisional application No. 62/332,339, filed on May 5, 2016.

(51) Int. Cl.
*A44C 5/20* (2006.01)

(52) U.S. Cl.
CPC ..... *A44C 5/2085* (2013.01)

(58) Field of Classification Search
CPC ... A44C 5/2085; A44C 13/00; Y10T 24/1441; Y10T 24/1443; Y10T 24/1486; A42B 3/185
See application file for complete search history.

(56) References Cited

U.S. PATENT DOCUMENTS

2016/0270491 A1* 9/2016 Spencer ..... A44C 5/185

OTHER PUBLICATIONS

Pictures of prior art clasps, date unknown.

* cited by examiner

*Primary Examiner* — Robert Sandy
(74) *Attorney, Agent, or Firm* — Stern & Schurin LLP

(57) ABSTRACT

In summary, there is provided an improved clasp having two mating sections that are in sliding engagement with one another. The first mating section includes an elongated cavity within which a shaft of the second mating section slides when the two mating sections are fastened to one another. The first mating section further includes a small tab that fits into a corresponding slot on a release lever positioned on the second mating section to hold and fasten the first mating section to the second mating section. When the release lever is pressed down, the mating sections slidably disengage from one another. Each of the mating sections incorporate a slide tube with a bendable flap, wherein the slide tube is sized and adapted to receive one or more rows of beads of one end of a beaded band or other assembly of beads.

19 Claims, 9 Drawing Sheets

CLASP FOR BEADED JEWELRY

RELATED APPLICATION

This application claims the benefit of and priority to U.S. Provisional Application 62/332,339 filed on May 5, 2016, which is incorporated herein by reference.

FIELD OF THE INVENTION

The present application relates generally to the field of jewelry. More specifically, the invention involves an improved clasp for jewelry. Even more particularly, the invention involves a clasp for use with a beaded jewelry that eliminates the need for sewing the band to the clasp and using a jump ring.

BACKGROUND OF THE INVENTION

In order to create a beaded band bracelet, a set of beads is typically woven together to create a beaded band. In one embodiment practiced in the prior art, the ends of the beaded band are sewn directly into loops connected to either side of a clasp. When the two mating sections of the clasp are separated, each section is attached and sewn to an end of the beaded band.

Another way to create the bracelet is to use a metallic slide tube which is adapted to receive one or more rows of beads within the tube. On the exterior of the tube is one or more loops. Once the beads of each of the two ends of the beaded band are fastened within a sliding tube, a user attaches each tube at each end of the band to a clasp that possesses one or more loops on either side. The loop(s) of the slide tube and loop(s) of the clasp are fastened to one another using a metal jump ring or other conventional mechanical attachment. Similarly, a fold-over clasp may be utilized in conjunction with a jump ring to secure a beaded band of flat woven cord or ribbons.

Although the use of a slide tube or fold-over crimp attachment helps eliminate the need to sew the band into loops on the clasp, current embodiments nevertheless still require an intermediary object, such as a jump ring, to connect the band to the clasp, thus extending the process of creating the desired jewelry. Similarly, the use of an intermediary object, such as the jump ring, sometimes lends itself to a less-than-desirable aesthetic.

SUMMARY OF THE PRESENT INVENTION

In view of the limitations and drawbacks in the prior art, it is a primary object of the present invention to provide an improved clasp having an integrally combined attachment member, such as a slide tube or fold-over crimp, to attach the ends of a beaded band assembly in the process of making beaded jewelry.

It is another object of the present invention to provide an improved clasp that saves time in the creation of beaded jewelry by eliminating the need to sew or use a jump ring.

A further object of the present invention is to provide an improved clasp that provides beaded jewelry with a more professional finish and desirable aesthetic.

Additional features of the improved clasp are described below in more detail.

In summary, there is provided an improved clasp having two mating sections that are in sliding engagement with one another. The first mating section comprises an elongated cavity within which a shaft of the second mating section slides when the two mating sections are fastened to one another. The first mating section further comprises a small tab that fits into a corresponding slot on a release lever positioned on the second mating section to hold and fasten the first mating section to the second mating section. When the release lever is pressed down, the mating sections slidably disengage from one another. Each of the mating sections incorporate a slide tube sized and adapted to receive one or more rows of beads of one end of a beaded band or other assembly of beads. In a preferred embodiment, each slide tube has a bendable flap or tab which are closed to retain the beaded band and prevent the end of the beaded band from sliding out.

BRIEF DESCRIPTIONS OF THE DRAWINGS

The above-described and other advantages and features of the present disclosure will be appreciated and understood by those skilled in the art from the following detailed description and drawings of which FIG. 1 is a right-side elevational view of a first preferred embodiment of the improved clasp of the present invention;

DETAILED DESCRIPTION OF THE INVENTION

Figure 1:
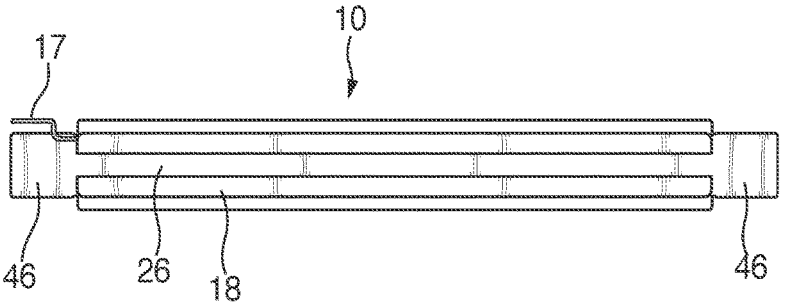
Figure 2:
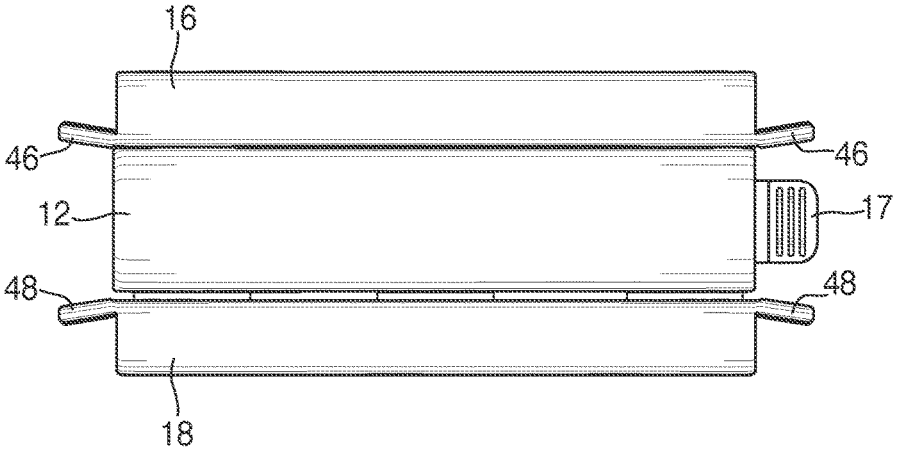
FIG. 2 is a top view thereof.
Figure 3:
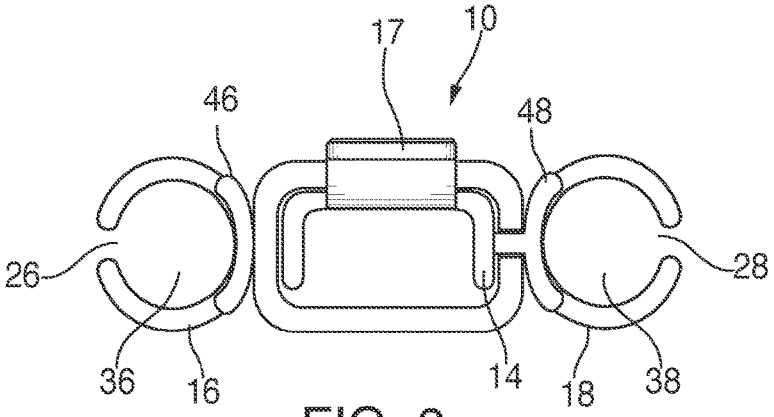
FIG. 3 is a front end view of the improved clasp showing the release lever.
Figure 4:
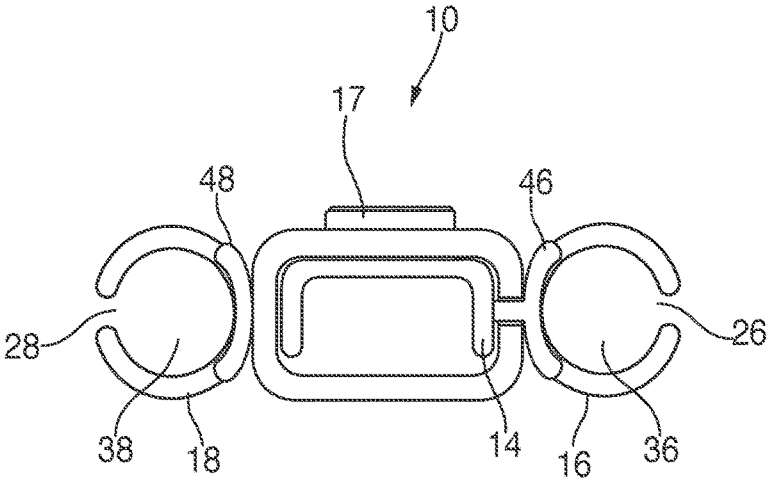
FIG. 4 is a rear end view of the improved clasp.
Figure 5:
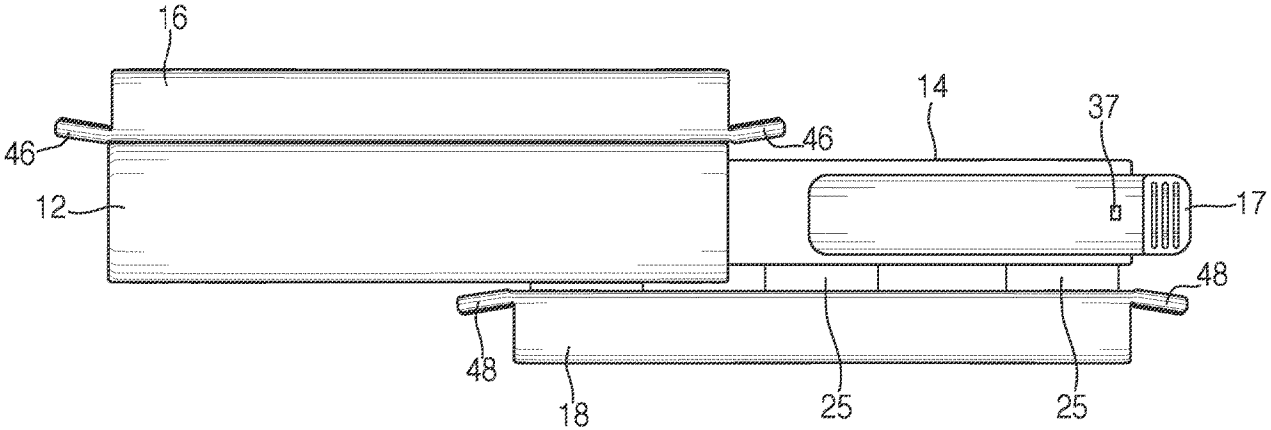
FIG. 5 is a top view of the improved clasp, with the first mating section partially separated from the second mating section.
Figure 6:
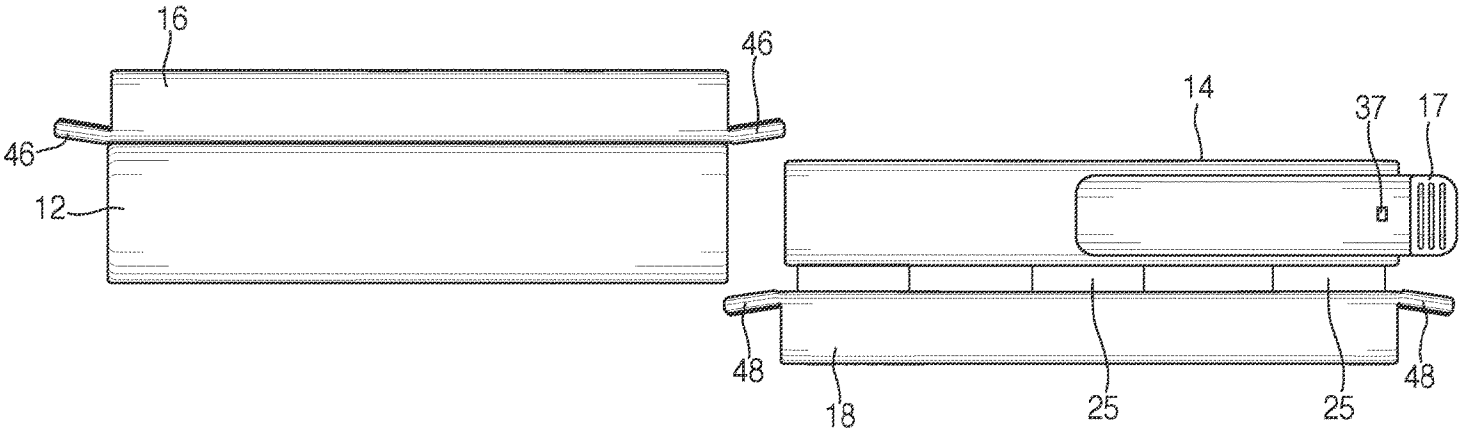
FIG. 6 is a top view of the improved clasp, with the first mating section entirely separated from the second mating section.
Figure 7:
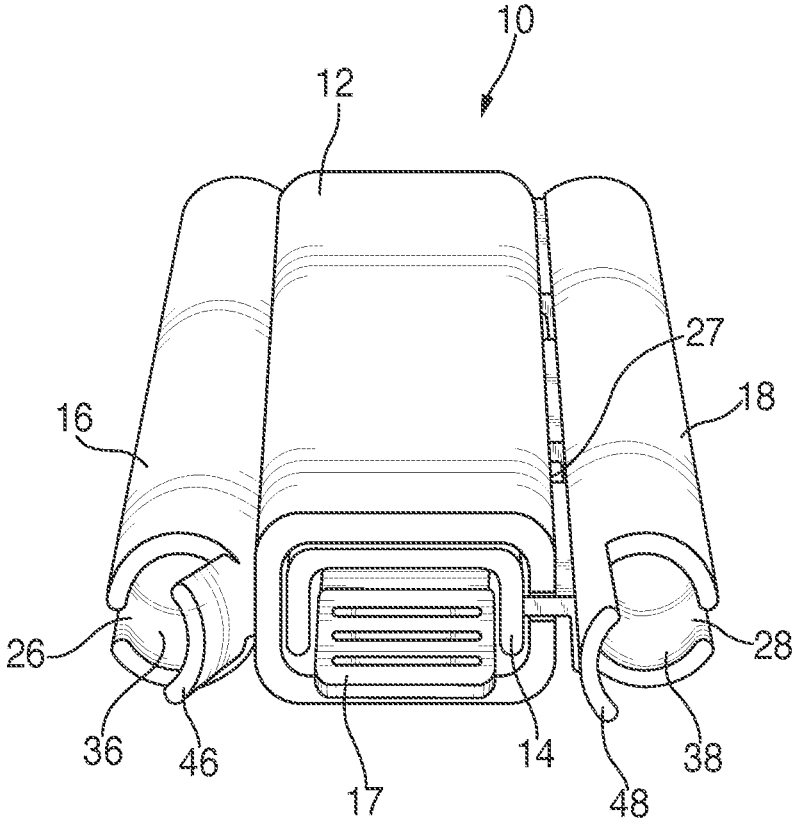
FIG. 7 is a bottom and front perspective view of the improved clasp showing the release lever and slide tubes thereof.
Figure 8:
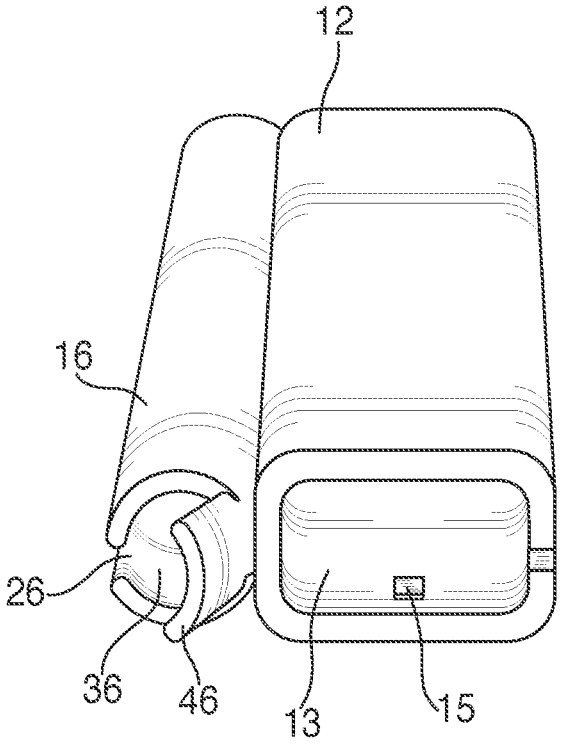
FIG. 8 is a bottom and front perspective view of the first mating section of the improved clasp.
Figure 9:
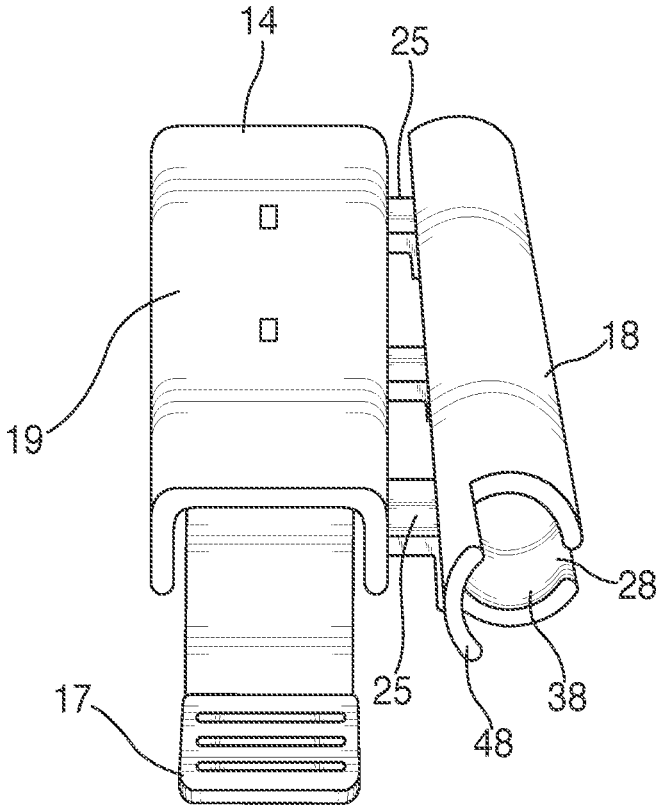
FIG. 9 is a top and front perspective view of the second mating section of the improved clasp with release lever.

With reference to FIGS. 1 through 9, there is shown a preferred embodiment of the improved clasp 10 of the present invention. The improved clasp 10 comprises two mating sections 12, 14 that are in sliding engagement to one another. The first mating section 12 incorporates an elongated cavity 13 within which a long shaft 19 of the second mating section 14 slides when the two sections 12, 14 fasten to one another. Shaft 19 is partially bent to form walls around the perimeter of shaft 19. The first mating section 12 further comprises a small tab 15 that fits into a corresponding slot 37 on a release lever 17 of the second mating section 14 to hold and fasten the first mating section 12 to the second mating section 14. When release lever 17 is pressed, first mating section 12 and second mating section 14 are able to slidably disengage from one another.

The first mating section 12 and second mating section 14 each comprise a slide tube 16, 18 which are sized and adapted to receive one or more rows of beads of one end of a beaded band or other assembly of beads. Slide tube 18 is attached to second mating section 14 via attachment bars 25. Slide tube 16 is fused or otherwise directly attached to mating section 12 (or by utilizing attachment bars which are shorter or are as shown in connection with slide tube 18). Attachment bars 25 are generally of sufficient length to enable slide tube 18 to clear the outer wall 27 of first mating section 12 when the first mating section 12 and second mating section 14 are engaged to one another. Notably, when the first mating section 12 and second mating section 14 are engaged to one another, attachment bars 25 pass through and rest within an attachment bar slot positioned laterally opposite the slide tube 16 of the first mating section 12. The location of the attachment bar slot of the first mating section 12 is intended to enable slide tubes 16, 18 to rest in line and parallel with one another as shown most clearly in FIG. 3 and FIG. 4.

In a preferred embodiment, each slide tube 16, 18 incorporates a slot 26, 28 and tubular cavity 36, 38 that each runs the length of slide tube 16, 18 respectively. Preferably, slots 26, 28 and tubular cavities 36, 38 are sized to permit use of beads (and corresponding beaded band ends with beads) which are small enough to fit within tubular cavities 36, 38 but are large enough so as to not exit the tubular cavities 36, 38 through slots 26, 28. Each slide tube 16, 18 further incorporates a bendable flap or tab 46, 48 at each of the two ends of slide tubes 16, 18. Once the ends of beaded band are positioned within slide tube 16, 18, bendable flaps 46, 48 are closed to prevent the ends from sliding out of either end of the slide tube 16, 18. These features enable slide tubes 16, 18 to retain the ends of a beaded band when the sections 12, 14 of improved clasp 10 are fastened or mated to one another.

Figure 10:
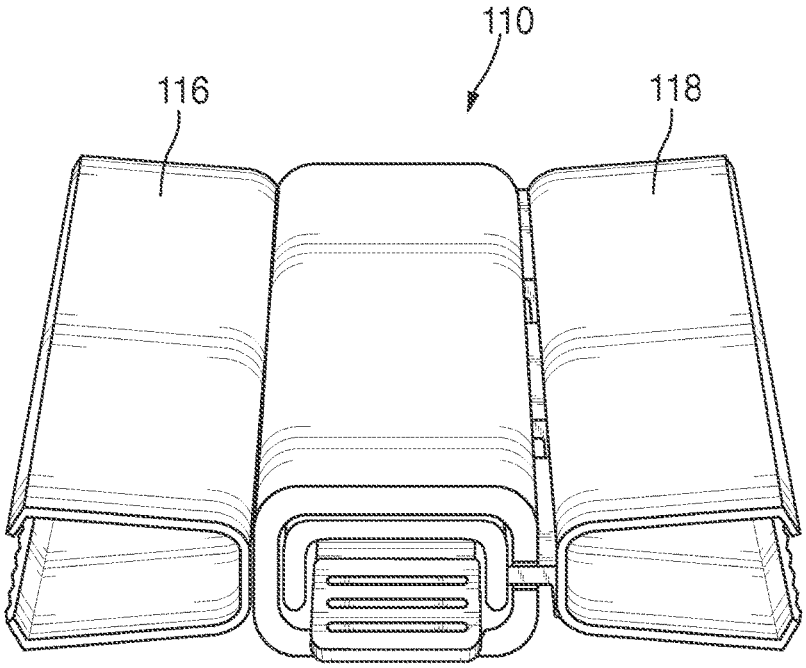
FIG. 10 is a top and front perspective view of a second preferred embodiment of the improved clasp of the present invention having a fold-over crimp attachment in place of a slide tube attachment.
Figure 11:
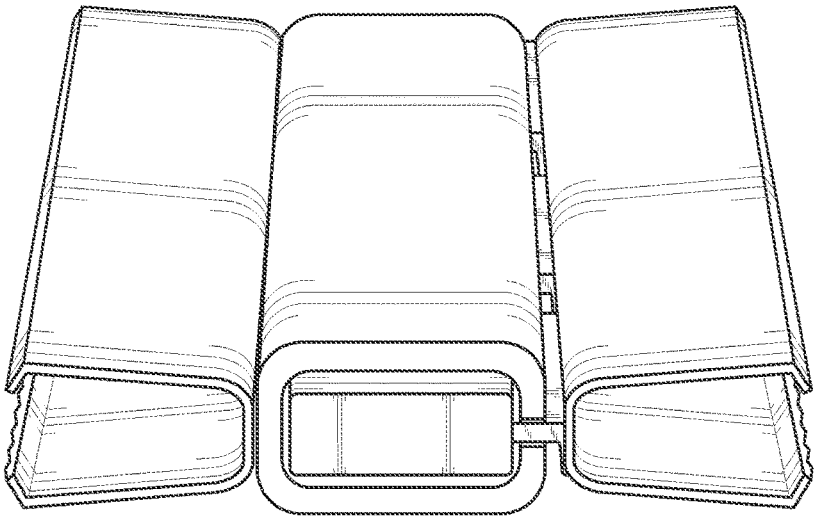
FIG. 11 is a bottom and rear perspective view thereof.
Figure 12:
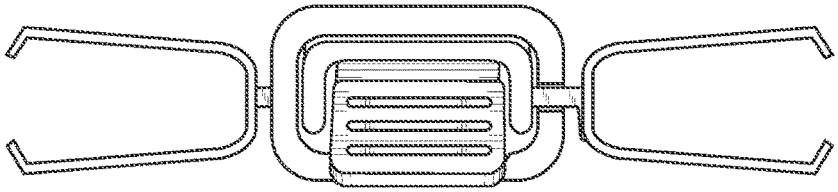
FIG. 12 is a front end view of the second preferred embodiment of the improved clasp having a fold-over crimp attachment in place of a slide tube attachment, showing the release lever.
Figure 13:
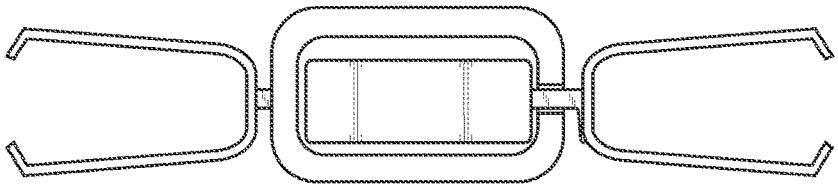
FIG. 13 a rear end view of the improved clasp.

With reference to FIGS. 10 through 13 there is shown a second preferred embodiment of the improved clasp 110 of the present invention. Generally, improved clasp 110 incorporates many of the same features that are present in improved clasp 10, with the following distinction(s). In place of slide tubes 16, 18, there are fold-over crimp attachments 116, 118 on the respective mating sections of the improved clasp 110.

Based on the features of improved clasp, a user no longer needs to sew a beaded band to loops in the clasp. Likewise, there is no longer a need for a jump ring to connect an end of the beaded band to the clasp.

The accompanying drawings only illustrate preferred embodiments of an improved clasp. However, other types and configurations are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first" and "second," and similar terms may be used herein to modify various elements. These modifiers do not imply a spatial, sequential, or hierarchical order to the modified elements unless specifically stated. Indeed, it should be appreciated, for example, that the terms "first" and "second" may be interchangeable such that the items to which they refer incorporate features of the other, where appropriate.

The invention claimed is:

1. An improved clasp for use with a beaded jewelry band having a first end and a second end, each of said first end and said second end terminating in at least one row of beads, comprising:

a first mating section having an elongated cavity, an attachment bar slot and a first slide tube;

a second mating section having an elongated shaft and a second slide tube attached to said second mating section via an attachment bar;

wherein said elongated shaft of said second mating section is partially bent to form walls around a perimeter of said shaft and is sized and adapted to be positioned within said elongated cavity of said first mating section, and said first mating section and said second mating section are in sliding engagement with one another; and further wherein said first slide tube is adapted and sized to receive said first end of said beaded jewelry band and said second slide tube is adapted and sized to receive said second end of said beaded jewelry band.

2. The improved clasp of claim 1, wherein said first slide tube is fused directly to said walls.

3. The improved clasp of claim 1, said elongated cavity of said first mating section having an outer wall and said attachment bar having a length to enable said second slide tube to clear said outer wall when the first mating section and the second mating section are locked to one another.

4. The improved clasp of claim 1, said first slide tube comprising a first slot and a first tubular cavity that runs the length of said first slide tube and said second slide tube comprising a second slot and a second tubular cavity that runs the length of said second slide tube.

5. The improved clasp of claim 4, wherein said first tubular cavity and said second tubular cavity are large enough to receive said row of beads.

6. The improved clasp of claim 5, wherein said first slot of said first slide tube and said second slot of said second slide tube are small enough to restrict said row of beads from exiting said first tubular cavity and said second tubular cavity through said first slot and said second slot.

7. The improved clasp of claim 6, wherein said first slide tube comprises a first bendable flap and said second slide tube comprises a second bendable flap to prevent beads from sliding out of said first tubular cavity and said second tubular cavity.

8. An improved clasp for use with a beaded jewelry band having a first end and a second end, each of said first end and said second end terminating in at least one row of beads, comprising:

a first mating section having an elongated cavity, an attachment bar slot, a first slide tube and a tab;

a second mating section having an elongated shaft, a second slide tube attached to said second mating section via an attachment bar and a release lever with a tab slot, wherein said tab is fitted to said tab slot to hold and fasten the first mating section to the second mating section;

wherein said elongated shaft of said second mating section is sized and adapted to be positioned within said elongated cavity of said first mating section, and said first mating section and said second mating section are in sliding engagement with one another; and further wherein said first slide tube is adapted and sized to receive said first end of said beaded jewelry band and said second slide tube is adapted and sized to receive said second end of said beaded jewelry band.

9. The improved clasp of claim 8, wherein when said release lever is depressed, said first mating section and said second mating section slidably disengage from one another.

10. An improved clasp, comprising:

a first mating section having an elongated cavity integrally fused to a first slide tube with a first tubular cavity, a first bead slot and a first bendable flap;

a tab positioned on said first mating section;

a second mating section having an elongated shaft integrally fused to a second slide tube with a second tubular cavity, a second bead slot and a second bendable flap;

a release lever having a locking tab slot attached to said elongated shaft of said second mating section;

wherein said elongated shaft of said second mating section is sized and adapted to be positioned within said elongated cavity of said first mating section, and said first mating section and said second mating section are in sliding engagement with one another; and wherein said tab is fitted to said locking tab slot to hold and fasten the first mating section to the second mating section when said first mating section and said second mating section are engaged with one another.

11. The improved clasp of claim 10, wherein when said release lever is depressed, said first mating section and said second mating section slidably disengage from one another.

12. The improved clasp of claim 10, wherein said first bead slot of said first slide tube and said second bead slot of said second slide tube are small enough to restrict beads from exiting said first tubular cavity and said second tubular cavity through said first bead slot and said second bead slot.

13. The improved clasp of claim 12, wherein said first bendable flap and said second bendable flap are bent to prevent beads from sliding out of said first tubular cavity and said second tubular cavity.

14. The improved clasp of claim 10, wherein said elongated cavity comprises a bent wall to form said elongated cavity and which also defines an attachment bar slot.

15. The improved clasp of claim 14, wherein said second slide tube is fused to said second mating section via an attachment bar.

16. The improved clasp of claim 15, wherein when said first mating section is engaged to said second mating section, said attachment bar rests and slides along said attachment bar slot.

17. The improved clasp of claim 16, wherein said first slide tube and said second slide tube rest in line with and parallel to one another when said first mating section is engaged to said second mating section.

18. The improved clasp of claim 17, said bent wall further defines a rectangular entrance into said elongated cavity.

19. The improved clasp of claim 10, wherein said first slide tube and said second slide tube each have two open ends, and each open end terminates in a bendable flap.

* * * * *